United States Patent [19]

Lawrence

[11] 4,270,620

[45] Jun. 2, 1981

[54] CONSTANT BOTTOM CONTACT TOOL

[75] Inventor: James D. Lawrence, Conroe, Tex.

[73] Assignee: Dailey Oil Tools, Inc., Houston, Tex.

[21] Appl. No.: 3,045

[22] Filed: Jan. 12, 1979

[51] Int. Cl.[3] ..... E21B 17/07

[52] U.S. Cl. ..... 175/322; 175/65

[58] Field of Search ..... 175/27, 317, 318, 321, 175/322; 166/334; 64/23, 27 C

[56] References Cited

U.S. PATENT DOCUMENTS

| | | | |
|---|---|---|---|
| Re. 26,745 | 12/1969 | Bottoms | 64/23 |
| 1,688,994 | 10/1928 | Smith | 175/321 |
| 1,785,086 | 12/1930 | Hauk | 175/317 |
| 1,794,196 | 2/1931 | Montgomery | 175/322 X |
| 1,817,067 | 8/1931 | Crowell | 175/322 X |
| 1,900,932 | 3/1933 | Hollestelle | 175/322 X |
| 2,754,086 | 7/1956 | Summers | 175/322 |
| 3,000,440 | 9/1961 | Malcomb | 175/321 |
| 3,208,541 | 9/1965 | Lawrence | 175/299 |
| 3,319,726 | 5/1967 | Brown | 175/321 X |
| 3,371,729 | 3/1968 | Carr | 175/321 X |

*Primary Examiner*—James A. Leppink
*Assistant Examiner*—Richard E. Favreau
*Attorney, Agent, or Firm*—Jack W. Hayden

[57] ABSTRACT

A drill string in a well bore has a mandrel extending longitudinally thereof adjacent the lower end of the drill string with a drill bit connected to the mandrel. Longitudinally extending helical groove means are provided in the mandrel and roller means are supported on the drill string and engaged with the helical groove means. Spring means is supported by the drill string and abuts the mandrel to tend to urge the mandrel longitudinally out of the drill string whereby the bit is urged into substantially continuous contact with the well bore bottom as the drill string is rotated during drilling operations. Valve means are provided for selectively circulating fluids from the drill string to the well bore above the drill bit, and when desired jar means may be incorporated in the drill string to impart an up or down jar thereto should the drill string become stuck or tend to become stuck during drilling operations.

8 Claims, 10 Drawing Figures

CONSTANT BOTTOM CONTACT TOOL

SUMMARY OF THE INVENTION

Various tools have been proposed and employed from time to time in an effort to maintain the drill bit on a drill string in contact with the bottom of the well bore during drilling operations. It can be appreciated that when a well bore is drilled in a water covered area from a structure such as a drill ship or the like, wave action on the movable structure may move the drill string and drill bit up and down in the well bore as the drill string is rotated during rotary drilling operations. Even when a well bore is drilled on shore, the rotation of the drill string and bit connected therewith may tend to cause the drill bit to "chatter" or to bounce up and down under some circumstances.

It can be appreciated that both on shore and off shore the drill string and the drill bit may be subjected to substantial impact loading and longitudinal stresses as well as torsional loads and stresses during drilling operations by reason of the above described actions.

The present invention contemplates an arrangement to maintain the drill bit in substantially constant contact with the bottom of the well bore while the well bore is being drilled with a rotary drill string in either on shore or off shore operations. Additionally, when desired a valve means may be incorporated in the present invention so that fluids may be circulated to the well bore at any desired elevation therein above the drill bit and beneath the tool of the present invention to flush debris or sediment from between the drill string and the well bore in which the present invention is employed. Additionally, suitable jar means and preferably the jar means as disclosed in U.S. Pat. Nos. 3,233,690 or 3,208,541 may be employed in the drill string to selectively impart either up or down jars or blows to the drill string should such drill string tend to become stuck or become stuck during drilling operations.

More particularly, the present invention provides a mandrel which extends longitudinally of the drill string adjacent its lower end with a drill bit being secured to the lower projecting end of the mandrel. Spring means are supported by the drill string and abut the mandrel to tend to urge the mandrel longitudinally out of the lower end of the drill string into constant contact with the well bore bottom during rotary drilling operations, and helical groove means extending longitudinally of the mandrel in which are engaged rollers which are supported by the drill string.

Another object of the present invention provides a mandrel which extends longitudinally of the drill string adjacent its lower end with a drill bit being secured to the lower projecting end of the mandrel. Helical groove means extend longitudinally of the mandrel in which are engaged rollers that are supported by the drill string whereby spring means supported by the drill string and abutting the mandrel tend to urge the mandrel longitudinally out of the lower end of the drill string into constant contact with the well bore bottom during rotary drilling operations. Seal means between the drill string and the mandrel spaced longitudinally from each end of the helical groove means seal off the groove means and rollers from well fluids.

Other objects and advantages of the present invention will become more readily apparent from a consideration of the following description and drawings.

DESCRIPTION OF THE PREFERRED EMBODIMENT

Figure 1:
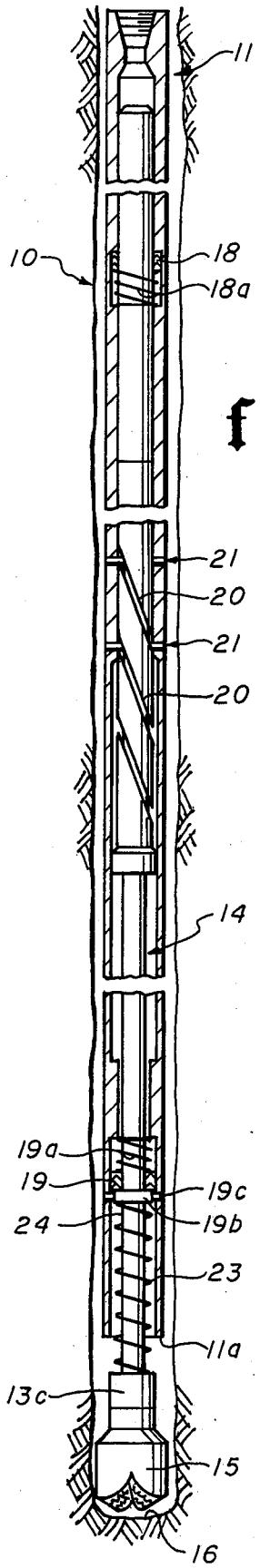
FIG. 1 is a longitudinal sectional view of a well bore illustrating schematically a form of the present invention in a drill string in the well bore.

In FIG. 1 a well bore is illustrated generally by the numeral 10. A drill string represented generally by the numeral 11 extends from the earth's surface into the well bore 10.

A mandrel 13 extends longitudinally within the lower end or lower portion of the drill string referred to generally at 14, such mandrel having a longitudinal bore extending therethrough so that well fluids circulated downwardly through the drill string may be discharged out through the drill bit 15 connected to the lower end of the mandrel 13.

Cooperating means are provided for supporting the mandrel telescopically within the lower portion 14 of the drill string 11 whereby rotation of the drill string 11 at the earth's surface by means well known in the art may be imparted to the mandrel 13 and drill bit 15 supported on the lower end thereof for drilling the well bore 10. Such cooperating means not only transmits rotation of the drill string 11 through the mandrel 13 to the bit 15, but such cooperating means also accommodates relative rotation and longitudinal movement between the mandrel 13 and the portion 14 of the drill string 11 in which the mandrel 13 extends during drilling operations.

Figure 2:
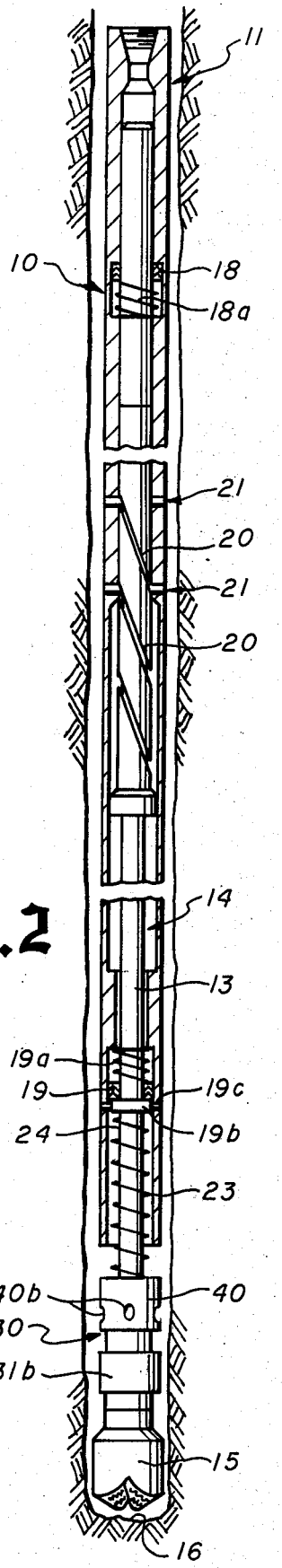
FIG. 2 is a longitudinal sectional view of a well bore similar to FIG. 1 with an alternate form of the present invention schematically illustrated in the well bore wherein flushing valve means are incorporated for circulating fluid from the drill string to the well bore above the bit when desired.
Figure 3:
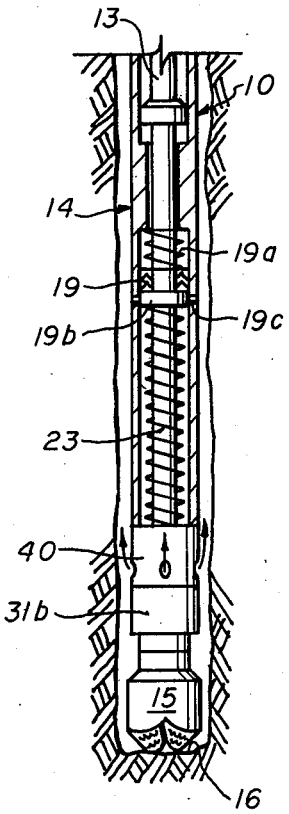
FIG. 3 is a partial sectional view of a well bore illustrating the lower end of the tool shown in FIG. 2 when the drill string has been lowered to actuate the flushing valve means to enable fluid to be communicated from the interior of the drill string and mandrel to the well bore for flushing above the bit.

The cooperating means includes helical groove means which may include one or more (and preferably three) longitudinally extending left hand grooves represented at 20 on the outer surface of the mandrel 13 as shown in the drawings. The drill string 11 supports roller means 21 which engage within the longitudinal extending groove means 20 as schematically illustrated in FIGS. 1, 2, and 4B and as more clearly illustrated in FIG. 5B of the drawings.

Spring means 23 surround the lower end of the mandrel 13 and are engaged at one end on the drill string as represented at 24 by any suitable arrangement while the other end is engaged on a sub **13*c* carried on the lower end of the mandrel 13. The spring means 23 tends to normally urge the mandrel 13 longitudinally to an extended position relative to the surrounding drill string portion 14. A drill bit 15 is threadedly connected to sub 13*c* and is urged into contact with the bottom 16 of the well bore 10 by the spring means 23 acting on mandrel 13** as above described.

As noted previously, rotary drilling operations both on shore and offshore subject the drill string 11 to substantial impact loading when the drill string 11 and drill bit 15 are moved up off the bottom 16 of the well bore and then reengaged on the bottom 16 of the well bore, such movement being caused by any one of a number of effects. When the drill bit 15 next strikes bottom, the drill bit may be damaged, and substantial shock loading is applied to the threaded connections of the drill string. Even the normal loads carried by a drill string 11 during rotary drilling operations are substantial and it is desirable to reduce if not completely eliminate any shock loading that may be applied thereto during such drilling operations, as well as reduce any torsional stresses applied throughout what may be a substantial length of drill string extending from the bottom 16 of the well bore to the earth's surface.

The arrangement illustrated schematically in FIG. 1 of the present invention accomplishes this in that it provides the roller means 21 which are engaged in the longitudinal helical groove means 20 and enable the mandrel 13 to move freely longitudinally and rotationally relative to the drill string 11 while the drill bit 15 is maintained in contact with the bottom 16 of the well bore 10 as the drill string 11 and bit 15 are rotated.

Since the mandrel 13 may move longitudinally and rotationally relative to the drill string, the mandrel 13, in effect, functions as a shock absorber to absorb impact loading that may be applied when the bit is moved up off of and then reengages the bottom 16 of the well bore 10. Torsional loads that might otherwise be conducted to the drill string 11 are reduced since the mandrel 13 may move rotationally relative to the drill string 11 to absorb torsional impact loading without substantially interfering with normal drilling operations.

In FIG. 2, valve means referred to generally at 30 are shown as being carried on the mandrel in spaced relation to and above the bit 15. While FIG. 2 illustrates the valve means immediately adjacent and above the bit, it can be appreciated that the valve means 30 may be positioned an additional distance above the bit 15 and beneath the lower end **11*a* of drill string 11** by employing a sub (not shown) of suitable length.

The valve means 30 is constructed so that it is normally closed during rotary drilling operations whereby fluid conducted down the drill string 11 and through the mandrel 13 is discharged through the bit 15 in a manner well known in the art. When it is desired, the valve means 30 may be opened to communicate the interior of the drill string 11 and the mandrel 13 with the well bore 10 above the drill bit 15 for flushing the well bore 10 to remove any sediment or deposit therefrom.

Figure 5A:
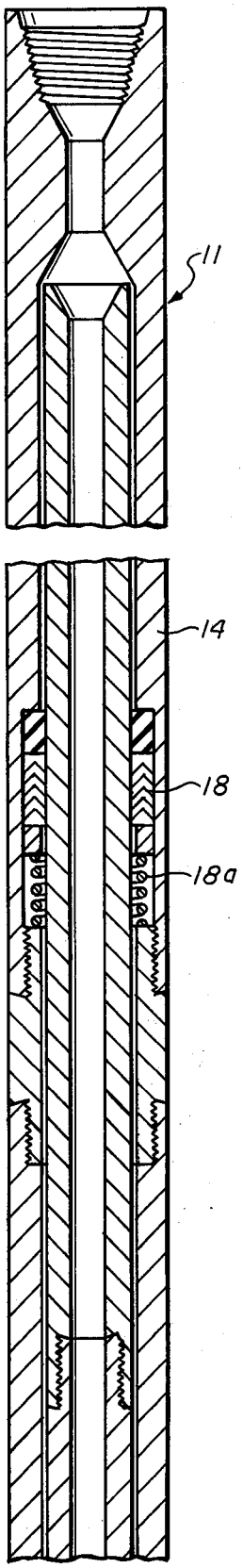
FIG. 5A is an enlarged sectional view of the upper end illustrating a preferred embodiment of the present invention.
Figure 5B:
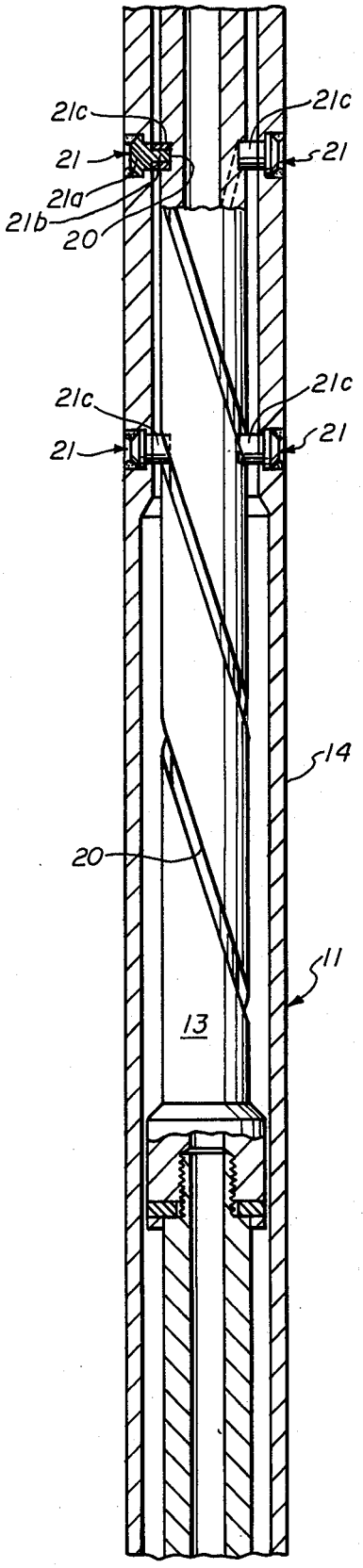
FIG. 5B is an enlarged sectional view and is a continuation of FIG. 5A and more clearly illustrates the longitudinal extending helical groove means in the mandrel and the roller means supported by the drill string engaged with the groove means.
Figure 5C:
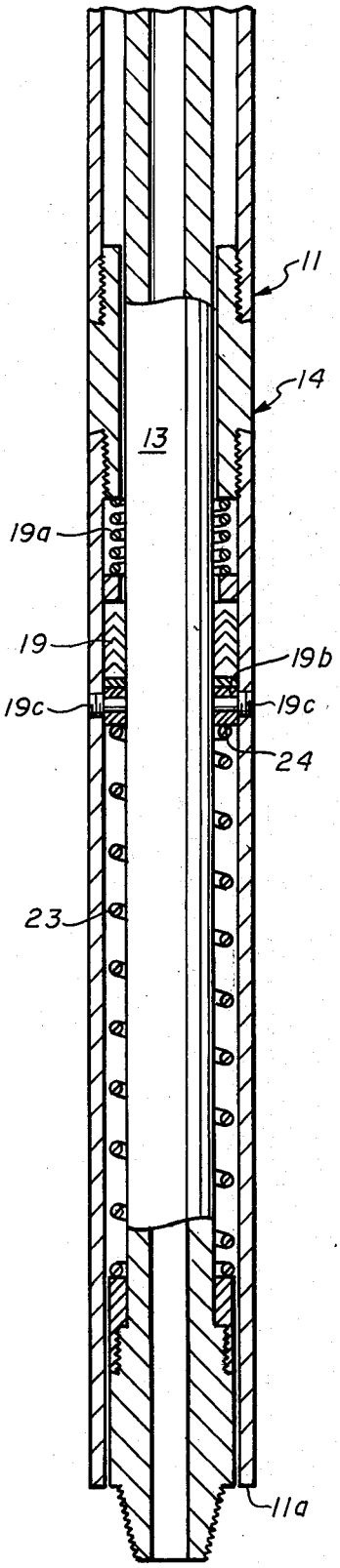
FIG. 5C is an enlarged sectional view which is a continuation of FIG. 5B and illustrates the arrangement of the spring means which tends to extend or urge the mandrel longitudinally outwardly relative to the lower end of a drill string.

FIGS. 5A–5C illustrate the drill string 11 and mandrel 13 is greater detail each of which may respectively include a plurality of tubular members which may be threadedly connected together in any manner well known. Suitable seal means as shown at 18 and 19 are provided for sealing off between the mandrel 13 and the interior of the drill string portion 14 in which the mandrel 13 telescopes to assure communication of fluid circulated downwardly through the drill string 11 through the mandrel 13 and out the bit 15 without any damaging effect to the components of the present invention. Such seal means may be of any suitable type and includes spring means **18*a* and 19*a* supported on each end by the drill string 11 in any suitable manner as illustrated in FIGS. 5A–5C to tend to compress or urge the seal means 18 and 19 into sealing engagement between the exterior of the mandrel 13 and the interior of the drill string portion 14. The seal means support for seal 19 includes collar 19*b* which abuts the seal means 19 and through which the mandrel 13 slidably extends. The collar 19*b* is secured to drill string 11 by pins 19*c* which extend through the drill string 11 and engage the collar 19*b* to hold it in place. Thus, the seals 18 and 19 are urged into sealing relationship with the drill string and the mandrel 13, while accommodating longitudinal movement of the mandrel 13** to accomplish the desired results of the present invention.

It will be noted that the roller means 21 as shown in FIG. 5B includes a member **21*a* secured to the drill string 11 with a spindle or stem 21*b* projecting inwardly therefrom upon which a roller 21*c* is rotatably carried and which roller engages in the helical groove means 20. It can be appreciated that there may be a plurality of such roller means 21 spaced longitudinally of the drill string portion 14 or engagement with the helical groove means 20 to accommodate the desired rotational and longitudinal movement between the drill string 11 and mandrel 13** during functioning of the device.

The roller means 21 freely accommodates the movement of the mandrel 13 relative to the drill string portion 14 while still transmitting rotational forces from the drill string 11 to the mandrel 13 to effect rotation of the drill bit 15 connected on the lower end of the mandrel 13.

Figure 6:
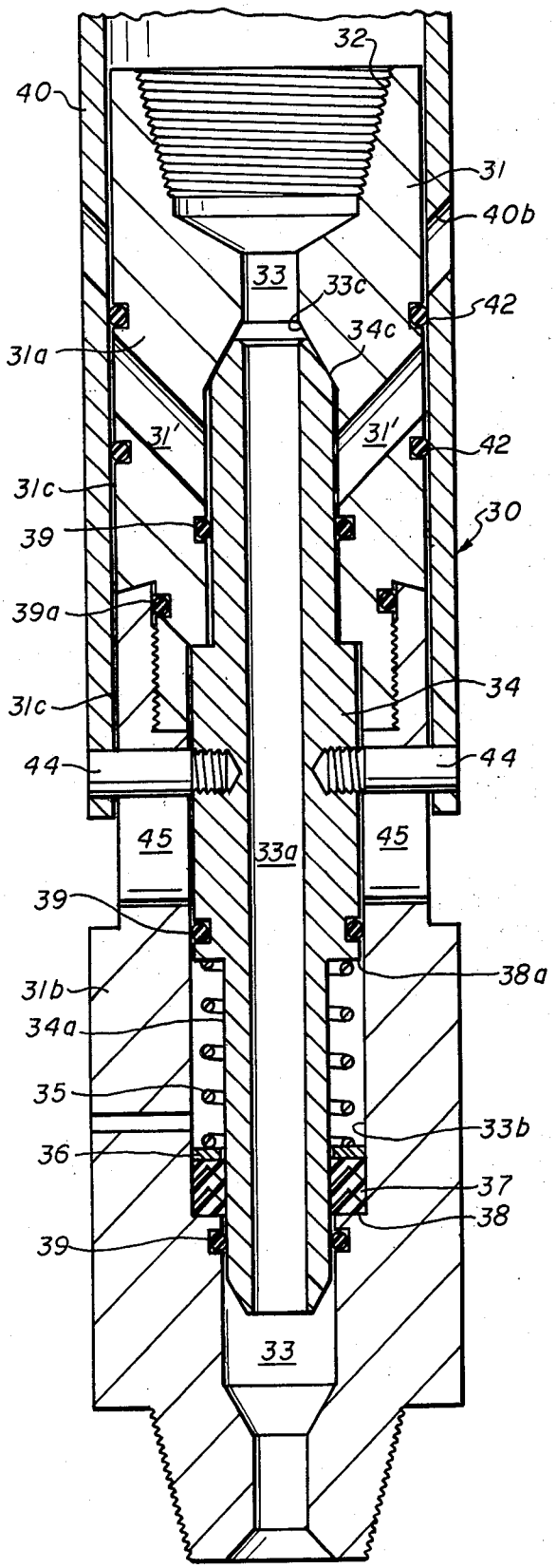
FIG. 6 is a sectional view of a form of the flushing valve means showing the valve element in normally closed position for circulating fluid through the drill string, the mandrel and the valve means to be discharged through the drill bit.
Figure 7:
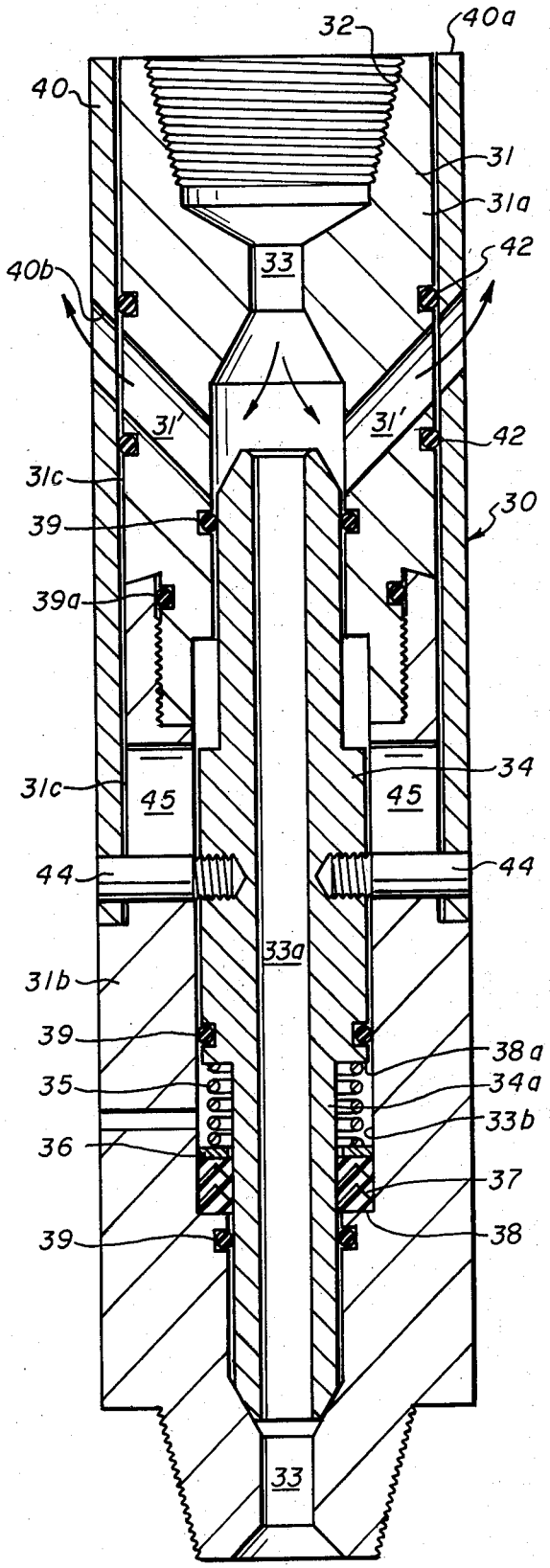
FIG. 7 is a longitudinal sectional view similar to FIG. 6 but illustrating the relationship of the components of the valve means after it has been actuated by the drill string to shift the valve element to communicate well fluid from interiorly of the drill string and mandrel to the well bore above the drill bit.

In FIGS. 6 and 7 the valve means 30 is again illustrated in enlarged section and is shown as including a valve body 31 which when used with the present invention is adapted to be connected to the lower end of the mandrel 13 by the threads 32. The valve body 31 includes a passage way 33 extending longitudinally thereof in which passage way is mounted the valve element 34. The valve element 34 is provided with a longitudinal bore **33*a* that communicates with the bore 33 in the valve body 31 as shown. Spring means 35 supported within the enlarged portion 33*b* of the longitudinal passage 33 abuts the ring 36 on seal means 37 which seal means 37 is supported on the shoulder 38 at one end of the enlarged portion 33b. The shoulder 38a formed on the reduced exterior 34a of the valve element 34 receives the other end of spring means 35 so that the valve element 34 is urged to the position shown in FIG. 6 of the drawing. When in this position, the upper end 34c sealingly engages the portion 33c of passage 33**.

In addition to the seal means 37, additional seal means as illustrated at 39 are provided between the valve element 34 and the longitudinal bore 33 in which it is mounted to inhibit leakage of fluid therebetween.

It will be noted that the valve body 31, a shown, comprises two parts 31a and 31b which are threadedly connected together with seal means 39a therebetween to inhibit leakage of fluid from the valve body 31. Sleeve means 40 are provided which fit snugly adjacent the reduced portion 31c formed on the exterior surface of parts 31a and 31b of the valve body 31 as shown.

Suitable seals 42 are provided between the sleeve means 40 and the reduced portion 31c on the body portion 31a as shown, such seal means 42 being provided on each side of the upwardly inclined passage means 31' in the valve body portion 31a as shown.

The sleeve means 40 is connected to the valve element 34 by means of the laterally extending pin members 44. Also, slots 45 extend longitudinally in the body portion 31b to accommodate movement of the lateral pins or extensions 44 when the housing 40 is moved downwardly when it is engaged at its upper end 40a by the lower end 11a of the drill string when the drill string 11 is lowered as will be described.

Generally, during normal rotary drilling operations the valve means 30 will assume the position illustrated in FIG. 6 of the drawings and fluid flow from the drill string 11 and the mandrel 13 will be conducted through the longitudinal bores 33 and 33a to be discharged through the drill bit 15 in a manner well known, since communication between bore 33 and passages 31' is prevented and since there is no communication between passages 31' and port means 40b in sleeve 40.

If however, it should become desirable to circulate into the well bore 10 above the drill bit 15 while the string 11 is in the well bore, the drill string 11 may be lowered by applying weight thereto with the drill bit 15 on the bottom 16 of the well bore 10. When this occurs the lower end 11a of the drill string as shown in FIGS. 2, 4B and 5C will engage the upper end 40a of the sleeve means 40 and shift it downwardly which in turns shifts the valve element 34 downwardly so as to expose the passage means 31' for communication with the interior of the mandrel through the longitudinal bore 33 as shown in FIG. 7 of the drawings and to align ports 40b in housing 40 with the passages 31'. Fluid may then be circulated outwardly and upwardly into the well bore 10 to flush any sediment or residue upwardly and out of the well bore along with the circulating well fluid.

After such flushing operation has been accomplished, the excess weight may be removed from the drill string 11 whereupon the drill string 11 will return to its normal position in the well bore as illustrated in FIGS. 2 and 4B wherein the mandrel 13 projects beyond the end 11a of the drill string 11 to urge the drill bit 15 on the bottom 16 of the well bore 10 and with the housing 40 in spaced relation to the lower end 11a of the drill string 11. The valve means 30 will reassure its closed position since spring means 35 will move element 34 upwardly when the drill string end 11a is moved away from sleeve end 40a.

As a practical matter, the driller at the earth's surface knows the weight of the drill string 11 in the well bore since he knows the depth of hold and type drill string. He also knows the longitudinal extent of the helical groove means 20 and the amount the mandrel 13 is extended when the spring 23 is fully extended. Generally, the driller will maintain the weight on the drill string so that during normal drilling operations the roller means 21 are intermediate the ends of the groove means 20 so that should shock loading occur to the drill bit 15, the mandrel 13 may move longitudinally and rotationally relative to the drill string 11 while drilling operations continue. The spaced relationship between the lower end 11a of the drill string 11 and the drill bit 15 when no flush valve means 30 is employed in shown in FIG. 1 and such relationship between the lower end 11a of the drill string 11 and the valve means 30 is illustrated in FIGS. 2 and 4B of the drawings. The spacing between the drill string end 11a and the bit sub, or top of sleeve 40 will be sufficient to accommodate substantial relative longitudinal movement between the mandrel 13 and drill string 11.

In some situations it is desirable to employ a jar means in the drill string during drilling operations to assist in releasing the drill string should it become stuck, and to inhibit sticking should such tendency occur.

Figure 4A:
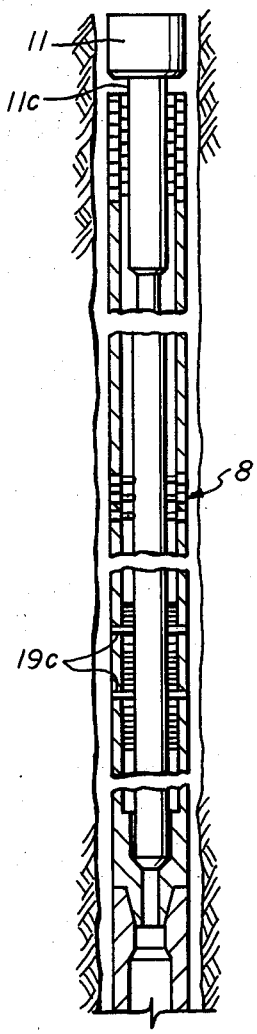
FIG. 4A is a schematic partial longitudinal sectional view of a jar means such as illustrated in U.S. Pat. No. 3,233,690, for incorporating in the drill string of the present invention.
Figure 4B:
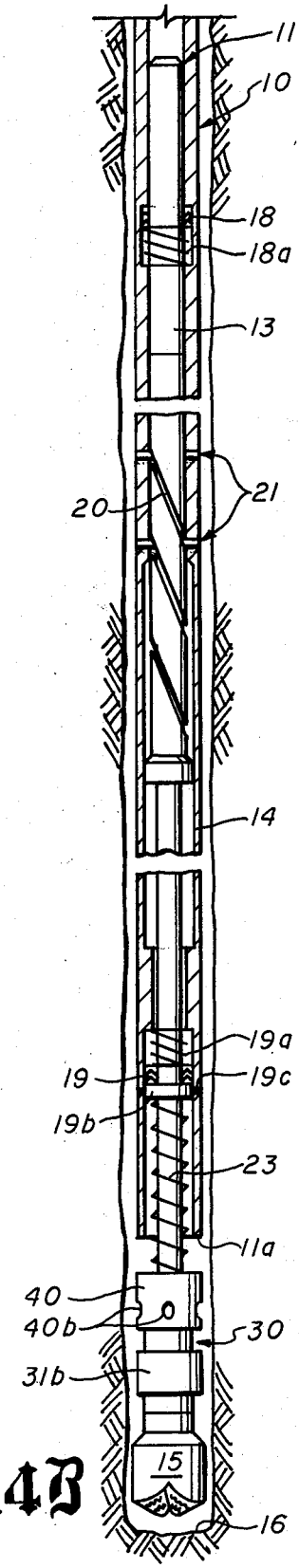
FIG. 4B is a longitudinal sectional view of a well bore and is a continuation of FIG. 4A in that it schematically illustrates the present invention therein.

FIG. 4A illustrates the drill string 11 with a reduced portion 11c extending longitudinally as shown. The reduced portion 11c extends into a drilling jar represented generally by the numeral 8, which drill jar is constructed preferably in accordance with U.S. Pat. No. 3,233,690. Such construction enables either an up impact or a down impact or a plurality of up impacts or a plurality of down impacts to be selectively applied to the drill string during drilling operations. This may be connected in the drill string above the arrangement illustrated in FIGS. 1 and 2 of the drawings.

From the foregoing it can been seen that a simple rugged construction is provided which may enable an increase of hole depth per hour of drilling time as well as increase the number of hours of drilling time per drilling bit. Additionally, the invention maintains the drilling bit in substantially constant contact with the bottom 16 of the well bore 10 thus overcoming or offsetting any up and down movement caused by ocean swells in off shore operations or up and down movement caused by drill bit chattering or bouncing off the bottom of the hole in either off shore or on shore operations. Thus , drilling forces are increased without increasing drill string loading and torsional stresses in the drill string are reduced which consequently reduces any twisting that might otherwise occur in the drill string, especially during those momentary interferences of drilling bit rotation.

The series of driving rollers 21 supported by the drill string 11 and engaged in the left hand groove means 20 of the mandrel 13 provides a positive drive between the rotating drill string 11 and the mandrel 13 while permitting the mandrel 13 to telescope up and down within the drill string 11 to offset movement caused by the ocean swells on off shore locations as well as overcoming bouncing or chattering of the drill bit 15 off the bottom 16 of the well bore in off shore as well as on shore operations.

Also, during the drilling operation the resolution of forces on the annular drive grooves 20 is in the downward direction, thus increasing drilling forces without increasing drill string load while reducing torsional forces on tool joints and connections in the drill string 11. Torsional stresses and resultant twisting of drill string are reduced by the present invention because any momentary interference in the rotation of the drilling bit 15 will be translated from a direct torsional stress build up that would occur in conventional fixed tooling to resolution of forces established by the angular drive provided with the left hand groove means 20 and rollers 31 engaged therewith. Stresses are further reduced by the upward telescoping movement of the mandrel 13 as momentary rotational interferences of drilling bit occur.

The foregoing disclosure and description of the invention are illustrative and explanatory thereof, and various changes in the size, shape, and materials as well as in the details of the illustrated construction may be made without departing from the spirit of the invention.

What is claimed is:

1. An arrangement for urging a drill bit on a drill string into substantially constant contact with a well bore bottom as it is rotated in drilling the well bore comprising:

(a) a mandrel;

(b) a drill bit on one end thereof;

(c) cooperating means supporting said mandrel telescopically within the lower end of the drill string whereby rotation of the drill string may be imparted to said mandrel and drill bit thereon while accommodating relative rotation and longitudinal movement between said mandrel and the drill string, said cooperating means including:

left hand helical groove means extending longitudinally on said mandrel;

roller means supported on the drill string and engaged in said helical groove means; and spring means abutting the drill string at one end and said mandrel at the other end to tend to extend said mandrel longitudinally out of the drill string and into engagement with the well bore bottom.

2. The invention of claim 1 including seal means between said drill string and mandrel and in spaced relation to each end of said helical groove means.

3. The invention of claim 2 including additional spring means supported by the drill string and abutting said seal means.

4. The invention of claim 1, 2 or 3 including normally closed valve means carried by said mandrel and operable by said drill string to open for communicating fluid through port means in said valve means to the well bore above the drill bit for flushing thereof.

5. The invention of claim 4 wherein said valve means comprises:

a. a valve element having a longitudinal bore therethrough;

b. spring means supported by said mandrel to maintain said valve element in position to normally close off flow through said valve means to the well bore above the drill bit;

c. sleeve means surrounding said mandrel and having port means therein;

d. seal means between said valve element and mandrel and between said sleeve means and said mandrel; and e. means connecting said sleeve means to said valve element whereby the drill string may be lowered to engage said sleeve means and move it and said valve element to conduct fluid from the mandrel to the well bore above the drill bit.

6. The invention of claim 1 including means supported by the drill string to selectively impart an upward jar or a downward jar to the drill string should it become stuck in the well bore.

7. The invention of claim 4 including means supported by the drill string to selectively impart an upward jar or a downward jar to the drill string should it become stuck in the well bore.

8. The invention of claim 5 including means supported by the drill string to selectively impart an upward jar or a downward jar to the drill string should it become stuck in the well bore.

* * * * *